US005495103A

United States Patent [19]

Utiger et al.

[11] Patent Number: 5,495,103

[45] Date of Patent: Feb. 27, 1996

[54] OPTICAL MAIL PIECE SENSOR FOR POSTAGE METER

[75] Inventors: Mark Utiger, Stettlen; Anton Poschung, Liebefeld, both of Switzerland

[73] Assignee: Ascom Hasler Mailing Systems AG, Bern, Switzerland

[21] Appl. No.: 213,929

[22] Filed: Mar. 16, 1994

[51] Int. Cl.[6] ..... H01J 40/14; B41L 47/46

[52] U.S. Cl. ..... 250/222.1; 250/559.4; 101/91

[58] Field of Search ..... 250/205, 221, 250/222.1, 223 R, 561, 559.4; 101/91, 233, 235

[56] References Cited

U.S. PATENT DOCUMENTS

| | | | |
|---|---|---|---|
| 2,130,897 | 9/1938 | Ogden | 101/235 |
| 2,693,754 | 11/1954 | Persson | 101/235 |
| 2,756,673 | 7/1956 | George | 101/233 |
| 2,934,009 | 4/1960 | Bach et al. | 101/235 |
| 3,738,643 | 6/1973 | Bell et al. | 271/52 |
| 3,898,930 | 8/1975 | Ikegami et al. | 101/316 |
| 4,019,619 | 4/1977 | Emenaker | 197/189 |
| 4,030,412 | 6/1977 | Springer | 101/132 |
| 4,132,401 | 1/1979 | Gauronski et al. | 271/245 |
| 4,310,755 | 1/1982 | Miller | 250/214 R |
| 4,442,769 | 4/1984 | Kallin | 101/93.19 |
| 4,520,725 | 6/1985 | Haug | 101/91 |
| 4,523,523 | 6/1985 | Abellana et al. | 101/235 |
| 4,571,925 | 2/1986 | Adams | 53/502 |
| 4,645,195 | 2/1987 | Scranton et al. | 271/246 |
| 4,831,273 | 5/1989 | Ross et al. | 250/561 |
| 4,840,696 | 6/1989 | Krasuski et al. | 156/353 |
| 4,876,959 | 10/1989 | Nobile et al. | 101/233 |
| 4,881,461 | 11/1989 | Nobile | 101/235 |
| 4,882,989 | 11/1989 | Nobile | 101/235 |
| 4,903,591 | 2/1990 | Nobile | 101/91 |
| 4,905,590 | 3/1990 | Nobile | 101/91 |
| 4,905,600 | 3/1990 | Nobile et al. | 101/235 |
| 4,905,980 | 3/1990 | Nobile et al. | 271/227 |
| 4,907,013 | 3/1990 | Hubbard et al. | 250/222.1 |
| 4,936,568 | 6/1990 | Nobile et al. | 271/265 |
| 5,203,263 | 4/1993 | Berger et al. | 101/76 |
| 5,321,252 | 6/1994 | Pickering, Jr. et al. | 250/561 |

*Primary Examiner*—Stephone B. Allen
*Attorney, Agent, or Firm*—Oppedahl & Larson

[57] ABSTRACT

An optical trigger is provided for use in a postage meter having a planar paper path. A light source with controllable intensity is mounted above the paper path and shines toward the paper path. A light sensor mounted above the paper path detects the reflected light if any. A dark region is provided below the paper path. More power is supplied to the light source when the sensor detects some light. An actuator is coupled with the printing mechanism of the meter to actuate it for printing of postage. When light is reflected from a mail piece, a timer is started, and when the timer reaches its programmed interval the actuator is actuated. The interval is adjustable by a trimmer adjustment, and two preprogrammed intervals may be selected by a front-panel switch.

29 Claims, 3 Drawing Sheets

OPTICAL MAIL PIECE SENSOR FOR POSTAGE METER

BACKGROUND

In a typical postage meter, also called a franking machine, a horizontal surface defines a paper path along which travels a mail piece such as an envelope. As the mail piece moves along the paper path toward the print rotor, it trips a mechanical trigger. The trigger causes the print rotor to turn and the mail piece is received and printed upon. The mail piece passes between a print rotor and a platen roller to receive an imprint of postage.

Those familiar with postage meters will appreciate that the rotor does not rotate continuously, but performs single revolutions in keeping with the arrival of mail pieces. Even if the mail pieces move continuously, the rotor movement is discontinuous. The rotor is motionless, at least briefly, between each printing cycle. From the point of view of the rotor and its trigger, mail pieces may arrive uninterruptedly for some time and then may stop abruptly. The trigger is a crucial part of the system that causes the rotor to rotate at the right times, and lets the rotor remain motionless at the right times.

A descending register keeps track of the amount of postage available for printing, and when the descending register shows a too-small amount the meter locks up and cannot print any more postage. Each rotation of the rotor causes postage value to be deducted from the descending register, and for that reason it is highly desirable that the rotor only be actuated for rotation when a mail piece is in place to receive the postage imprint. Errors in either direction are troublesome. If the rotor rotates with no mail piece is place, then the user of the postage meter loses money. If a mail piece arrives and the rotor does not move, then this constitutes a jam that will have to be cleared.

The range of printing problems to be guarded against is much greater than simply printing postage when it is not needed, or failing to print postage. If a postage imprint is mispositioned this is also a serious problem. Relative to the right edge of an envelope, if the imprint is too far to the right then part of the imprint may be off the paper and result in a spoiled piece of mail. If the imprint is too far to the left, the imprint may overlap printed portions of the envelope such as the return address, or in an extreme case may stray past the left edge of the envelope. These problems are, at the very least, aesthetically displeasing, and can also result in loss of postage value or jams.

These problems present themselves in any postage meter, but are particularly troublesome in meters that are intended for high-speed use with as many as 10,000 pieces per hour receiving postage imprints. With such meters it is desired to have a trigger mechanism for the printing of postage that consistently prints postage in the desired position on the mail piece, and that can easily be set to predetermined configurations to accept different types of mail pieces. A traditional prior-art mechanical trigger does not work well with thin pieces, for example, air mail envelopes, and it can degrade mechanically and abrade.

One prior-art example of a trigger mechanism for use in a postage meter is U.S. Pat. No. 5,203,263, assigned to the same assignee as the present application and incorporated by reference. Another prior-art example is U.S. Pat. No. 4,523,523 to Abellana et al. A few other prior-art references mention postage meters and optical sensors, namely U.S. Pat. Nos. 4,840,696, 4,571,925, and 4,310,755.

SUMMARY OF THE INVENTION

An optical trigger is provided for use in a postage meter having a planar paper path. A light source with controllable intensity is mounted above the paper path and shines toward the paper path. A light sensor mounted above the paper path detects the reflected light if any. A dark region is provided below the paper path. More power is supplied to the light source when the sensor detects some light. An actuator is coupled with the printing mechanism of the meter to actuate it for printing of postage. When light is reflected from a mail piece, a timer is started, and when the timer reaches its programmed interval the actuator is actuated. The interval is adjustable by a trimmer adjustment, and two preprogrammed intervals may be selected by a front-panel switch.

DESCRIPTION OF THE DRAWING

The invention will be described with reference to a drawing in several figures, of which.

DETAILED DESCRIPTION

Figure 1:
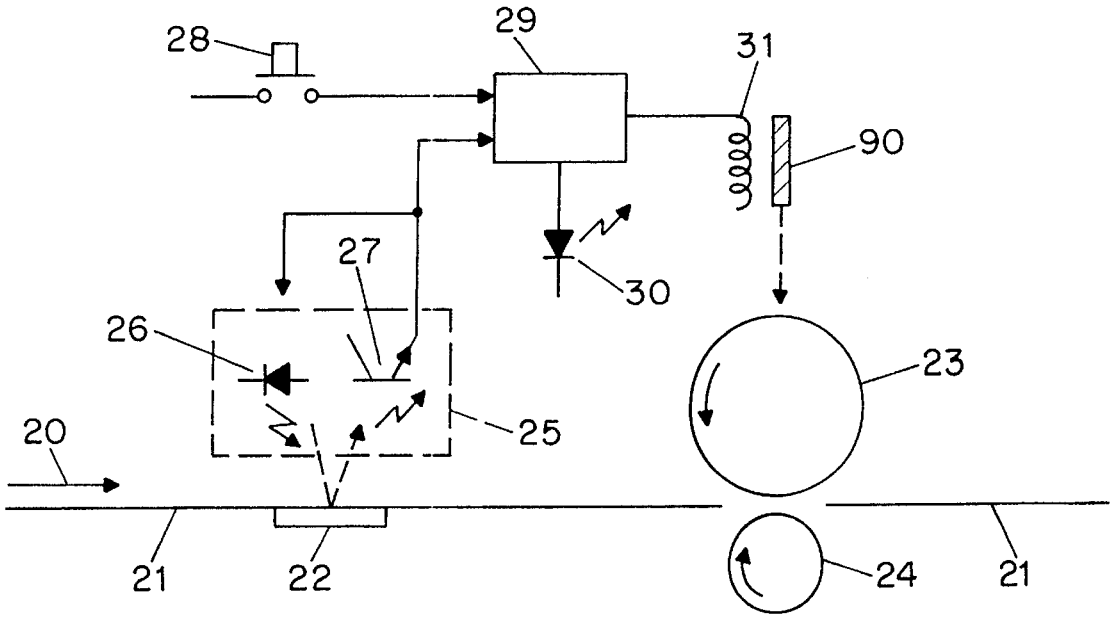
FIG. 1 shows in simplified form the trigger mechanism according to the invention.

FIG. 1 shows in simplified form the trigger mechanism according to the invention. The mail piece approaches as shown by arrow 20 along a paper path defined by surface 21. The mail piece passes between print rotor 23 and platen roller 24, but only after passing and triggering a trigger mechanism.

Figure 4:
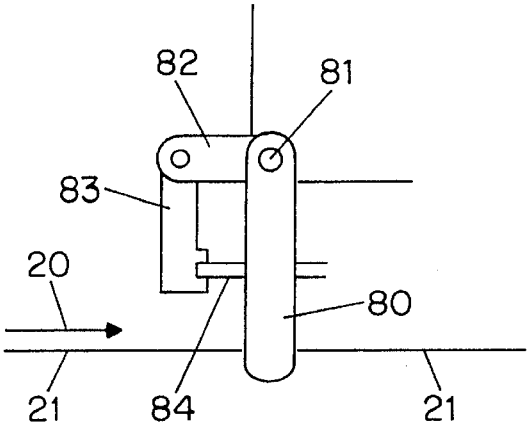
FIG. 4 PRIOR ART
FIG. 4 shows in side view a pure-mechanical trigger of the prior art arrangement.

Turning now to FIG. 4, what is shown in cutaway side view is a pure-mechanical trigger such as is used in the prior art. The mail piece 20 enters the postage meter from the left in FIG. 4, and approaches the trigger lever 80. Lever 80 rotates relatively freely on shaft 81 which is rotates within a bearing, not shown in FIG. 4, that is fixed to the main body of the meter. At the other end of shaft 81 is arm 82, which rotates in fixed relationship with trigger 80. Arm 82 is also connected with arm 83, which engages member 84. Member 84 triggers a single revolution of rotor 23 (see, for example, FIG. 1) by a single-revolution mechanism well known in the prior art and omitted for clarity from FIG. 4.

Figure 5:
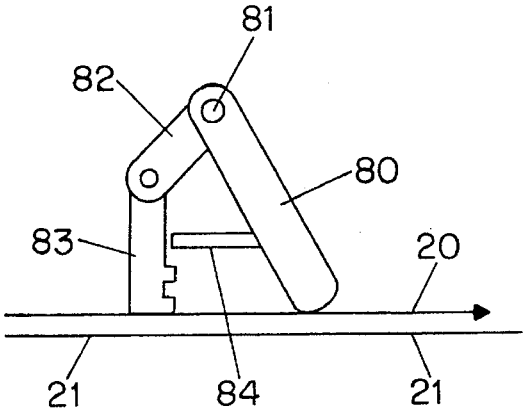
FIG. 5 PRIOR ART
FIG. 5 shows in side view the prior art trigger of FIG. 4, with a mail piece passing past the trigger.

FIG. 5 shows in side view the prior art trigger of FIG. 4, with a mail piece 20 passing past the trigger 80. As may be seen, trigger 80 rotates, causing arm 82 to rotate. This forces arm 83 to move downward, which momentarily deflects member 84, causing the rotation of the print rotor (omitted for clarity in FIG. 5).

Returning now to FIG. 1, the inventive optical trigger is shown in simplified form. LED 26 directs light toward a nonreflective (dark) area 22. If a mail piece 20 is received along the paper path defined by surface 21 (and if the mail piece is sufficiently reflective) then it will arrive at the area 22, and will reflect light to phototransistor 27. LED 26 and phototransistor 27 make up integrated assembly 25.

As shown in FIG. 1, the output from phototransistor 27 reaches electronics 29, and also feeds back to the LED 26. Another input to electronics 28 is a pushbutton 28 which, as described in more detail below, permits the user to select either of two timing relationships in activating the print rotor 23. Electronics 29 actuates solenoid 31, which moves core 90, which activates the mechanism that rotates the print rotor 23.

Figure 2:
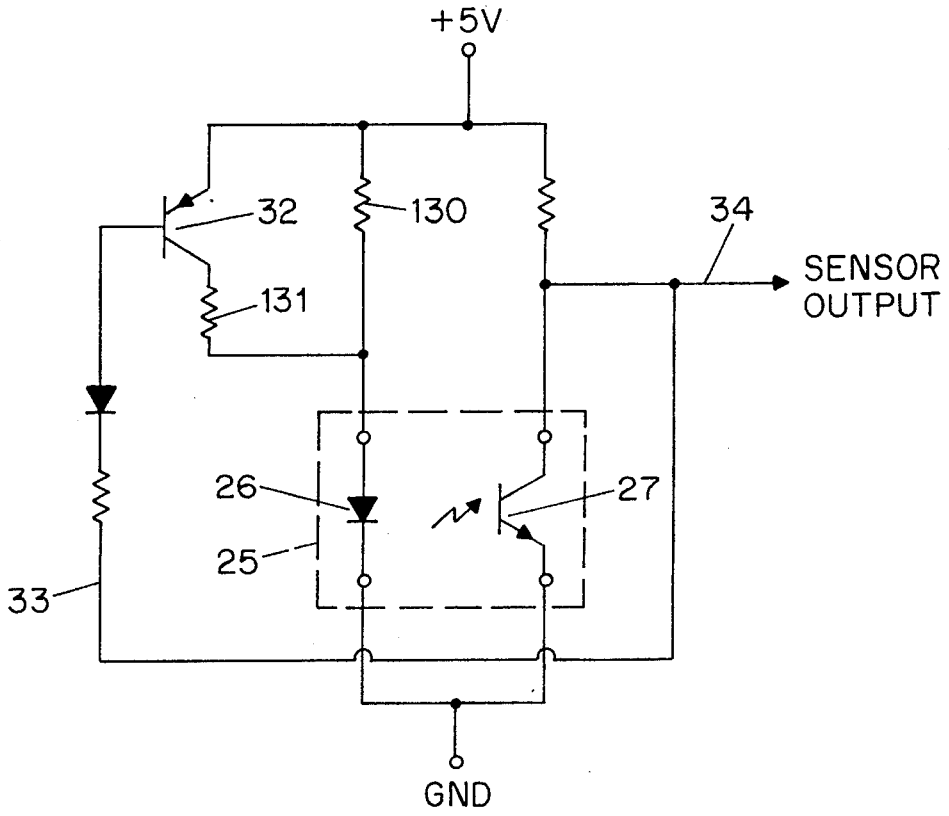
FIG. 2 shows in schematic detail the circuitry surrounding the sensing electronics thereof.

Turning now to FIG. 2, what is shown in schematic detail is the circuitry surrounding the sensing electronics of the optical trigger according to the invention. The pertinent electrical connections are power and ground, and a sensor signal output 34.

Output line 34 is generally at a high (+5 V) level due to the pullup resistor shown, but phototransistor 27 pulls the output line 34 to a low level in the event light is detected at the phototransistor 27. Light-emitting diode 26 gets its power through resistor 130. When the phototransistor 27 turns on due to detection of light, the output 34 is also supplied via line 33 to transistor 32, turning it on. When transistor 32 turns on a second current path supplies current to LED 26 through resistor 131. Thus the LED 26 gets a little brighter. In this way there is some hysteresis in the response of the sensor to changing light levels, which helps to provide some noise immunity. The practical result is that when a mail piece is at the area 22, the output 34 is low, and otherwise the output 34 is high.

It will be appreciated that the light source 26 is shown as a light-emitting diode, but could be other technologies such as incandescent. The light sensor 27 is shown as a phototransistor, but other technologies such as photodiode or photocell could be used. The particular circuitry shown whereby the sensing of light causes the light source to get brighter is thought to be preferable but one skilled in the art could readily devise other circuitry arrangements bringing about the described result. The voltages used and the sense associated with them (e.g. low voltage on line 34 means light is sensed) are of course quite arbitrary, although what is shown is preferred; one could employ other voltages and could invert the sense without departing in any way from the invention. Preferably the photons emitted by the LED are infrared, and the phototransistor is selected to detect infrared, but other wavelengths could be used as well.

Figure 3:
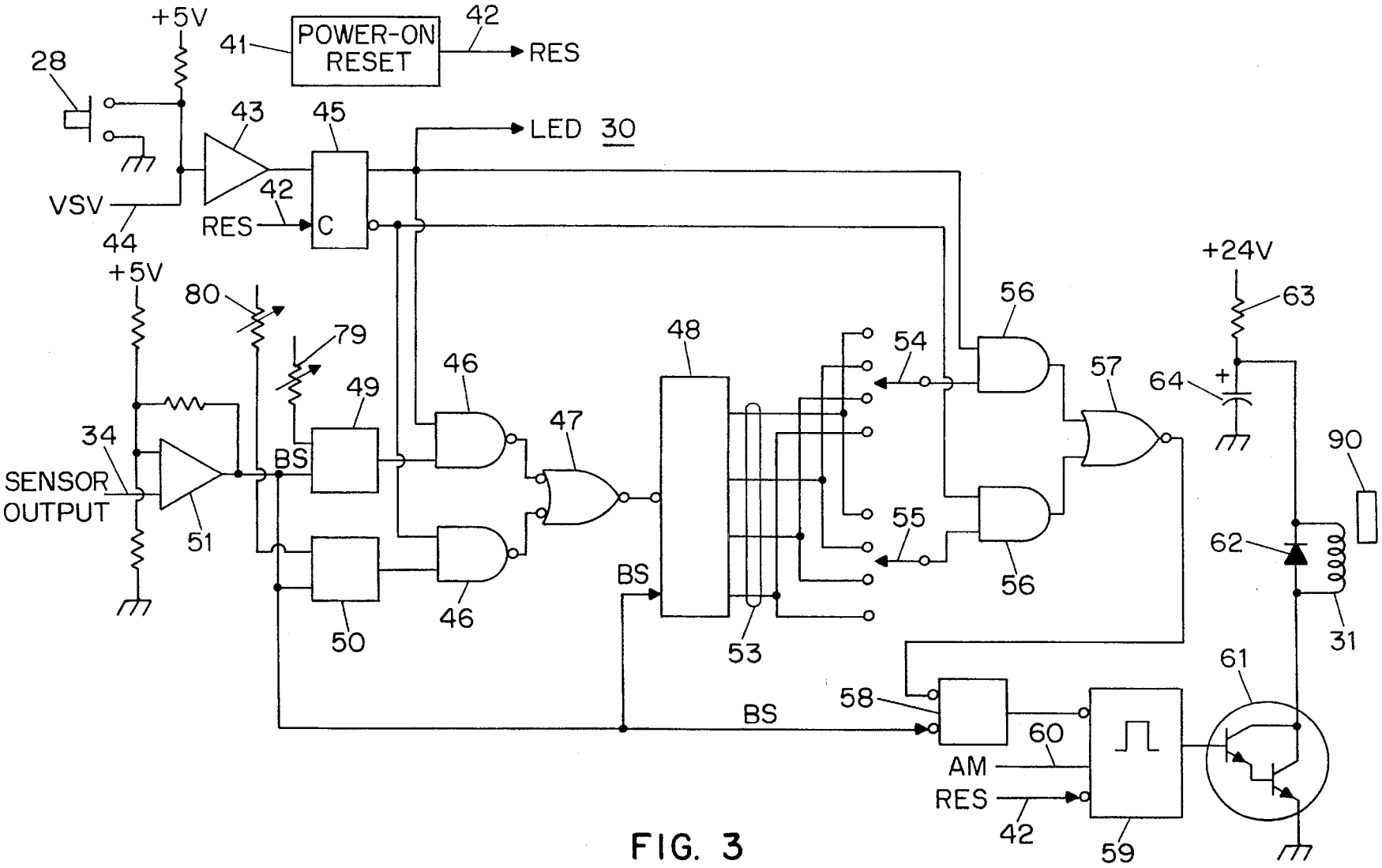
FIG. 3 shows in schematic detail the timer circuitry thereof.

FIG. 3 shows in schematic detail the timer circuitry 29 (see FIG. 1). Inputs to the circuitry electronics 29 will now be discussed. The user pushbutton 28 is shown in FIG. 3 (also shown in FIG. 1) providing a signal to gate 43 to toggle the state of flip-flop 45. The flip-flop 45 may also be toggled by a signal from line 44, called USV. Signal USV is a remote control line that permits other circuitry to toggle the flip-flop 45. As will be discussed further below, the state of the flip-flop 45 selects either of two delay gates and either of two clock delay times.

Another input is the sensor signal 34 from the phototransistor 27 (see FIG. 2). That signal is compared with a threshold by comparator 51, and the output BS of the comparator starts both delay gates 49, 50. Each of the delay gates 49, 50 has a respective potentiometer 79, 80 that is adjustable by the user.

Yet another input is the power-on-reset circuitry 41 of conventional design. Its output RES 42 sets initial states for many of the gates of the electronics 29.

The electronics 29 has several outputs, most notably the energizing current output to solenoid 31. Another output is from flip-flop 45, which provides a signal to LED 30 (see also FIG. 1).

Gates 46, 47 comprise a multiplexer or selector determining which of delay gates 49, 50 will provide an input to counter 48, the selection of which is determined by the outputs of flip-flop 45. In a similar way gates 56, 57 comprise a multiplexer or selector determining which of switch outputs 54, 55 will provide an input to gate 58, the selection of which is also determined by the outputs of flip-flop 45.

Counter 48 starts counting when started by the input from gate 47. As the count increases, the four outputs 53 successively turn on. The switches 54, 55 together with the selector of gates 56, 57 determine which of the four outputs 53 will be an input to gate 58.

The output from gate 58 is an input to one-shot 59, which provides an output of a predetermined duration to activate the solenoid 31. A signal AM 60 is received from other circuitry, and permits the other circuitry to prevent postage printing activity even if a user causes a mail piece to trigger the optical sensor.

Darlington transistor 61 switches the relatively high current provided through the solenoid 31, and diode 62 protects the transistor 61 against back EMF in the solenoid 31 when it is turned off. The solenoid 31 receives a filtered DC that is stored in electrolytic capacitor 64.

In this way the trigger signal 34 from the sensor starts a delay gate 49 or 50, which starts a counter 48, which defines a delay interval before solenoid 31 is activated. The total delay time is selected by the position of switches 54, 55, of potentiometers 79, 80, and by the state of flip-flop 45, which is shown by LED 30 and is toggled by the pushbutton.

The output BS from comparator 51 is, as described above, an input triggering the delay gates 49, 50. Thus it might appear that the entire control path is simply a delay that carefully links a signal at the sensor input 34 with the energizing of the solenoid 31 at a predetermined later time. But if the circuitry were that simple there is the possibility that the user could take actions selecting a time delay that was far too long (for example by mistaken adjustment of the potentiometer 79, 80 or the switch 54, 55) in which case there is the possibility of a mail piece passing beyond the print rotor before the solenoid is energized. The result is postage being printed not on the mail piece but on the platen roller. This wastes money and requires manual operations to send the mail piece through the meter again.

In the system according to the invention the output BS from comparator 51 reenters the control path at two locations—at the counter 48 and again at the gate 58. The reason for having the signal BS enter the control path at three locations is to reduce the likelihood of such printing of postage on the platen roller. For the solenoid to be energized it is necessary not only that the phototransistor be receiving light, but also that the phototransistor continue to be receiving light at the time when counter 48 receives the signal from the delay gate 49, 50, and that the phototransistor continue to be receiving light at the time when the output selected by switch 54, 55 is asserted.

One way to describe this embodiment is that first and second timers are provided. The first timer, composed of elements 49, 50, 46, and 47, starts timing upon assertion of the sensor output and generates its output at a selected delay time after the assertion of the sensor output. The second timer, composed of elements 48, 54, 55, 56, and 57, starts timing upon the concurrent assertion of the sensor output and of the output of the first timer. At the output of the second timer yet another logical operation is performed, namely that the actuator is actuated only if, concurrently, the sensor output is asserted and the second timer's output is asserted.

In the preferred embodiment the delay times of the two timers are user-adjustable only together, that is, the output of the flip-flop 45 changes both of the delays at once. Those skilled in the art can appreciate that it would be possible to allow user selection of the two delays independently if desired.

Several benefits come from the arrangement embodied in FIG. 3. First, as mentioned above, inadvertent adjustment by the user that results in too long a delay (so that postage would be printed on the platen roller instead of the mail piece) is guarded against. Second, a nuisance triggering of the comparator 51, due to any of several possible mechanical or electrical causes, is guarded against.

Those skilled in the art will appreciate that while the embodiment of FIG. 3 is preferred, many other embodiments would accomplish the benefits just described. For example, instead of random logic as set forth in the figure, a microcontroller could be used, executing a stored program. The stored program would implement one or both of the delays in software, introducing the phototransistor logic level at one or both of the points in the sequential calculation. Stated differently, the microcontroller would activate the solenoid at a time T only if the phototransistor signal were asserted at time T, and at time T–I2 and at time T–(I1+I2), where I1 and I2 are delays conforming to those of the hardware logic of FIG. 3. I1 corresponds to the delay of elements 49, 50, 46, and 47, while I2 corresponds to the delay of elements 48, 54, 55, 56, and 57. In the microcontroller embodiment the delays I1 and I2 would, of course, be user-adjustable through appropriate user inputs.

Those skilled in the art will also appreciate that the delays associated with triggering the solenoid could also be accomplished in a general-purpose processor running a suitable stored program, with user inputs to permit adjusting the delays.

Figure 6:
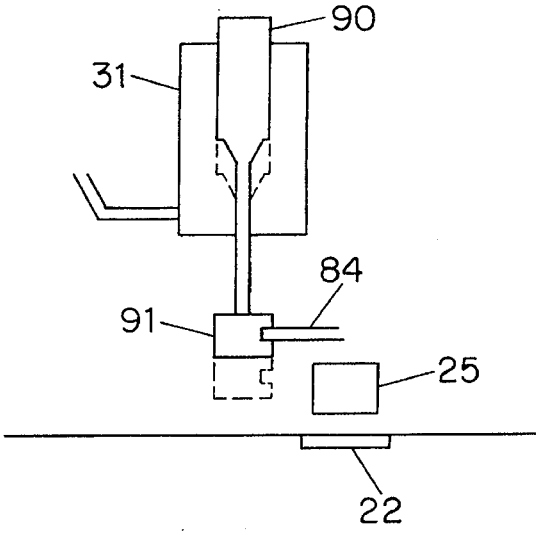
FIG. 6 shows in side view corresponding to FIG. 4 the solenoid actuator arrangement according to the invention.

FIG. 6 shows in side view corresponding to FIG. 4 the solenoid actuator arrangement according to the invention. It will be recalled from the discussion of FIGS. 4 and 5 that deflection of member 84 is what causes the print rotor to rotate through a single revolution. Solenoid 31 has core 90 which is capable of moving up and down, and which is generally in the upwards position shown. When the solenoid 31 is energized, magnetic flux tends to draw the core 90 downwards, to the position shown in dotted lines. The core 90 is connected with member 91 which engages member 84. Movement of the core 90 downwards thus actuates the single-revolution mechanism (omitted for clarity in FIG. 6) so that the print rotor rotates once to print postage.

Also shown in FIG. 6 are the LED-phototransistor assembly 25, located above the paper path and juxtaposed with dark region 22.

From the user's point of view the operation of the optical trigger is much better than the operation of the prior-art mechanical trigger. Depending on the intrinsic mechanical delays in the postage meter, and depending on the speed at which mail pieces move through the meter, the postage imprint is printed more or less close to the front edge of the mail piece. Adjustment of the imprint location is in two steps. First, a coarse adjustment is made by changing the position of switch 54 or 55. Second, a fine adjustment is made by changing the position of potentiometer 79 or 80. The two-step adjustment, coarse and fine, is repeated for the other user-selectable delay time, after pressing the pushbutton 28 and noting that the LED 30 is in its other state (on or off).

The usual method is to set the rotor to print a zero postage amount, and then to print several sample mail pieces. If necessary the potentiometer is adjusted clockwise or counterclockwise to cause the imprint to land on the desired portion of the mail piece.

The first of the two user-selectable delays is in effect when the machine is turned on (because of the power-on circuitry 41 which resets flip-flop 45). To alternate between the two delays, the user presses pushbutton 28. This turns the LED 30 on and off.

Advantages of optical release or trigger include that thin papers such as air mail envelopes are not damaged by impact with a mechanical release or trigger. The optical system does not abrade or wear, so it ages much more gracefully.

The invention is not, of course, meant to be limited to the particular embodiments set forth in detail above. Rather, those skilled in the art will have no difficulty devising alternative embodiments deviating in no way from the invention, which is defined by the following claims.

We claim:

1. An optical trigger for use in a postage meter defining a planar paper path having a first side and a second side, the postage meter having printing means actuable for printing postage, the trigger comprising:

a light source mounted on a first side of the planar paper path and directing its output toward the paper path;

a light sensor mounted on the first side of the paper path having a sensor output indicative of sensed light received from the paper path, the positions of the light source and light sensor selected so that the light sensor does not receive light in a direct path from the light source;

a dark region on the second side of the paper path positioned opposite the light source and the light sensor;

an actuator coupled with the printing means actuating the printing means for printing of postage;

a user input means generating a user signal; and a timer means responsive to the user signal and to assertion of the sensor output for actuating the actuator at a time that follows the sensor output by at least one delay interval determined by the user signal.

2. The trigger of claim 1 wherein the light source and light sensor comprise a light-emitting diode and phototransistor both mounted above the paper path and directed downwards toward the dark region located below the paper path.

3. The trigger of claim 1 further comprising a control means powering the light source and responding to the sensor output by supplying more power to the light source when the sensor output is indicative of sensed light; wherein the light source comprises a light-emitting diode having first and second terminals, wherein is further provided a power supply having first and second power supply terminals, the second terminals of the light source and the power supply connected together, and wherein the control means comprises a first resistor connected between the first terminals of the light source and power supply and, in parallel with the first resistor, a second resistor and a transistor in series combination, the base of the transistor connected with the sensor output; whereby the sensor output turns on the transistor.

4. The trigger of claim 1 wherein the actuator comprises a solenoid mechanically coupled to the printing means.

5. The trigger of claim 1 wherein the user input means is a pushbutton, and wherein the timer means further comprises a flip-flop toggled by the pushbutton, the timer means further characterized in that the at least one delay interval comprises first and second delay intervals, the timer means selecting either of the first and second delay intervals in response to the state of the flip-flop, the timer means further comprising a light visible to a user and indicative of the state of the flip-flop.

6. The trigger of claim 5 wherein the timer means further comprises first and second trimmer adjustments accessible to the user, the first and second trimmer adjustments adjusting the first and second delay intervals.

7. The trigger of claim 1 wherein the timer means actuates the actuator only at such time as the delay interval has passed and the sensor output continues to be asserted.

8. An optical trigger for use in a postage meter defining planar paper path having a first side and a second side, the postage meter having printing means actuable for printing postage, the trigger comprising:

a light source mounted on a first side of the planar paper path and directing its output toward the paper path;

a light sensor mounted on the first side of the paper path having a sensor output indicative of sensed light received from the paper path, the positions of the light source and light sensor selected so that the light sensor does not receive light in a direct path from the light source;

a dark region on the second side of the paper path positioned opposite the light source and the light sensor;

an actuator coupled with the printing means actuating the printing means for printing of postage;

a timer means responsive to the user signal and to the sensor output for actuating the actuator at a time that follows the sensor output by a first at least one first delay interval; and a first user-accessible trimmer adjusting the first at least one delay interval.

9. The trigger of claim 8 wherein the light source and light sensor comprise a light-emitting diode and phototransistor both mounted above the paper path and directed downwards toward the dark region located below the paper path.

10. The trigger of claim 8 further comprising a control means powering the light source and responding to the sensor output by supplying more power to the light source when the sensor output is indicative of sensed light; wherein the light source comprises a light-emitting diode having first and second terminals, wherein is further provided a power supply having first and second power supply terminals, the second terminals of the light source and the power supply connected together, and wherein the control means comprises a first resistor connected between the first terminals of the light source and power supply and, in parallel with the first resistor, a second resistor and a transistor in series combination, the base of the transistor connected with the sensor output; whereby the sensor output turns on the transistor.

11. The trigger of claim 8 wherein the actuator comprises a solenoid mechanically coupled to the printing means.

12. The trigger of claim 8 wherein is further provided a user input comprising a pushbutton, and wherein the timer means further comprises a flip-flop toggled by the pushbutton, the timer means further characterized in that the at least one delay interval comprises first and second delay intervals, the timer means selecting either of the first and second delay intervals in response to the state of the flip-flop, the timer means further comprising a light visible to a user and indicative of the state of the flip-flop.

13. The trigger of claim 8 wherein the timer means further comprises a second trimmer adjustment accessible to the user, the second trimmer adjustment adjusting the second delay interval.

14. An optical trigger for use in a postage meter defining a planar paper path having a first side and a second side, the postage meter having printing means actuable for printing postage, the trigger comprising:

a light source with controllable intensity mounted on a first side of the planar paper path and directing its output toward the paper path;

a light sensor mounted on the first side of the paper path having a sensor output indicative of sensed light received from the paper path, the positions of the light source and light sensor selected so that the light sensor does not receive light in a direct path from the light source, a dark region on the second side of the paper path positioned opposite the light source and the light sensor;

a control means powering the light source and responding to the sensor output by supplying more power to the light source when the sensor output is indicative of sensed light;

an actuator coupled with the printing means actuating the printing means for printing of postage; and a timer means responsive to the sensor output for actuating the actuator at a time that follows the sensor output by a first at least one first delay interval.

15. The trigger of claim 14 wherein the light source and light sensor comprise a light-emitting diode and phototransistor both mounted above the paper path and directed downwards toward the dark region located below the paper path.

16. The trigger of claim 14 wherein the light source comprises a light-emitting diode having first and second terminals, the control means comprising a power supply having first and second power supply terminals, the second terminals of the light source and the power supply connected together, and wherein the control means further comprises a first resistor connected between the first terminals of the light source and power supply and, in parallel with the first resistor, a second resistor and a transistor in series combination, the base of the transistor connected with the sensor output; whereby the sensor output turns on the transistor.

17. The trigger of claim 14 wherein the actuator comprises a solenoid mechanically coupled to the printing means.

18. The trigger of claim 14 wherein is further provided a user input comprising a pushbutton, and wherein the timer means further comprises a flip-flop toggled by the pushbutton, the timer means further characterized in that the at least one delay interval comprises first and second delay intervals, the timer means selecting either of the first and second delay intervals in response to the state of the flip-flop, the timer means further comprising a light visible to a user and indicative of the state of the flip-flop.

19. The trigger of claim 18 wherein the timer means further comprises first and second trimmer adjustments accessible to the user, the first and second trimmer adjustments respectively adjusting the first and second delay intervals.

20. A method of operation of a postage meter defining a planar paper path having a first side and a second side, the postage meter having printing means actuable for printing postage, the method comprising the steps of:

directing light toward the paper path;

detecting light reflected from the paper path;

responding to the detection of light by starting a timer timing a predetermined interval; and actuating the printing means upon the expiration of the predetermined interval only if light is still detected.

21. The method of claim 20 further comprising a second responding step of responding to the detection of light by starting a second timer timing a second predetermined interval;

wherein the first responding step comprises starting the timer only if light is detected and if the second timer's interval has expired.

22. An optical trigger for use in a postage meter defining a planar paper path having a first side and a second side, the postage meter having printing means actuable for printing postage, the trigger comprising:

a light source mounted on a first side of the planar paper path and directing its output toward the paper path;

a light sensor mounted with respect to the paper path having a sensor output indicative of sensed light received from the paper path;

an actuator coupled with the printing means actuating the printing means for printing of postage;

a first timer means responsive to the sensor output generating a delayed signal delayed by an at least one delay interval, and actuating the actuator at such time as the delayed signal and the sensor output are both asserted.

23. The trigger of claim 22 wherein the light source and light sensor comprise a light-emitting diode and phototransistor both mounted above the paper path and directed downwards toward a dark region located below the paper path.

24. The trigger of claim 22 further comprising a control means powering the light source and responding to the sensor output by supplying more power to the light source when the sensor output is indicative of sensed light; wherein the light source comprises a light-emitting diode having first and second terminals, wherein is further provided a power supply having first and second power supply terminals, the second terminals of the light source and the power supply connected together, and wherein the control means comprises a first resistor connected between the first terminals of the light source and power supply and, in parallel with the first resistor, a second resistor and a transistor in series combination, the base of the transistor connected with the sensor output; whereby the sensor output turns on the transistor.

25. The trigger of claim 22 wherein the actuator comprises a solenoid mechanically coupled to the printing means.

26. The trigger of claim 22 wherein is further provided a user input means, and wherein the first timer means is further responsive to the user input means for varying the length of the delay.

27. The trigger of claim 26 wherein the user input means is a pushbutton, and wherein the first timer means further comprises a flip-flop toggled by the pushbutton, the first timer means further characterized in that the at least one delay interval comprises first and second delay intervals, the first timer means selecting either of the first and second delay intervals in response to the state of the flip-flop, the first timer means further comprising a light visible to a user and indicative of the state of the flip-flop.

28. The trigger of claim 27 wherein the first timer means further comprises first and second trimmer adjustments accessible to the user, the first and second trimmer adjustments adjusting the first and second delay intervals.

29. The trigger of claim 22 further comprising a second timer means, the second timer means responding to the sensor output for generating a second delayed signal delayed by a delay interval, further characterized in that the first timer means starts only at such time as the second delayed signal and the sensor output are both asserted.

* * * * *